United States Patent [19]

Brownson

[11] 3,945,499

[45] Mar. 23, 1976

[54] STORAGE HOOK FOR RAZOR AND BLADES

[76] Inventor: De Witt M. Brownson, 10808 62nd St., Temple Terrace, Fla. 33617

[22] Filed: June 21, 1974

[21] Appl. No.: 481,808

[52] U.S. Cl. ..... 211/88; 211/60 T; 248/309 R

[51] Int. Cl.[2] ..... A47G 29/08

[58] Field of Search ..... 248/309, 311, 110, 37.6; 211/88, 49 D, 60 R, 60 T; D4/3

[56] References Cited

UNITED STATES PATENTS

| | | | |
|---|---|---|---|
| 825,774 | 7/1906 | Stumm | 211/88 |
| 865,475 | 9/1907 | Belisle | 211/88 |
| 2,443,329 | 6/1948 | Sears | 248/309 |
| 2,635,843 | 4/1953 | Small | 248/309 |
| 3,341,026 | 9/1967 | Spitler | 211/88 |
| 3,395,298 | 7/1968 | Shifley | 248/309 X |
| 3,664,622 | 5/1972 | Vaccaro | 211/88 |
| D206,426 | 12/1966 | Wise | D4/3 |

*Primary Examiner*—Roy D. Frazier
*Assistant Examiner*—Darrell Marquette
*Attorney, Agent, or Firm*—Blair & Brown

[57] ABSTRACT

A rack for mounting on a wall and which serves to store a safety razor and a cartridge of safety razor blades when not in use; the device consisting of one piece molded plastic or the like, and including a vertical back wall from an upper portion of which there forwardly extends a cup-like structure over a front lip of which the safety razor can be hooked so to depend therefrom, an open tray formed in front of the lower end of the back wall and in which the blade cartridge is stored in upright position by resting against a series of vertical ribs formed on the front side of the back wall.

3 Claims, 4 Drawing Figures

STORAGE HOOK FOR RAZOR AND BLADES

BACKGROUND OF THE INVENTION

1. Field of the Invention

This invention relates generally to racks. More specifically it relates to holders for storage of safety razors and safety razor blade cartridges.

2. Description of the Prior Art

It is well known that heretofore numerous cases and trays have been designed for the purpose of storing safety razors and blade cartridges between uses, and which were intended for convenient placement upon counter tops or inside medecine chests, which however unfortunately are often over-crowded, or which do not provide adequate air circulation for drying out these articles when laid down therein. This situation is therefore in want of an improvement.

SUMMARY OF THE INVENTION

In accordance with the present invention, there is provided a Storage Hook for retaining the safety razor and blade cartridge in a stored position between uses, the Storage Hook incorporating a bottomless cup over an upper lip of which the safety razor is suspended, and the Storage Hook including a tray formed by a series of vertical ribs and an inclined wall between which the blade cartridge is supported; openings at the cup bottom, between the ribs and on the tray bottom allowing ventilation for these shaving articles.

Another object of the present invention is to provide a Storage Hook for a safety razor and blade cartridge which is designed to be wall-mounted so that it facilitates the organization of a shaving area.

Other objects are to provide a storage hook which is simple in design, inexpensive to manufacture, rugged in construction, easy to use, and efficient in operation.

These and other objects will be readily evident upon a study of the following specification and the accompanying drawing, wherein:

BRIEF DESCRIPTION OF THE DRAWING

FIG. 3 is a side cross-sectional view taken on line 3—3 of FIG. 2, and illustrating the safety razor and blade cartridge in both a stored and removing position respective thereto.

DESCRIPTION OF SPECIFIC EMBODIMENT

Figure 1:
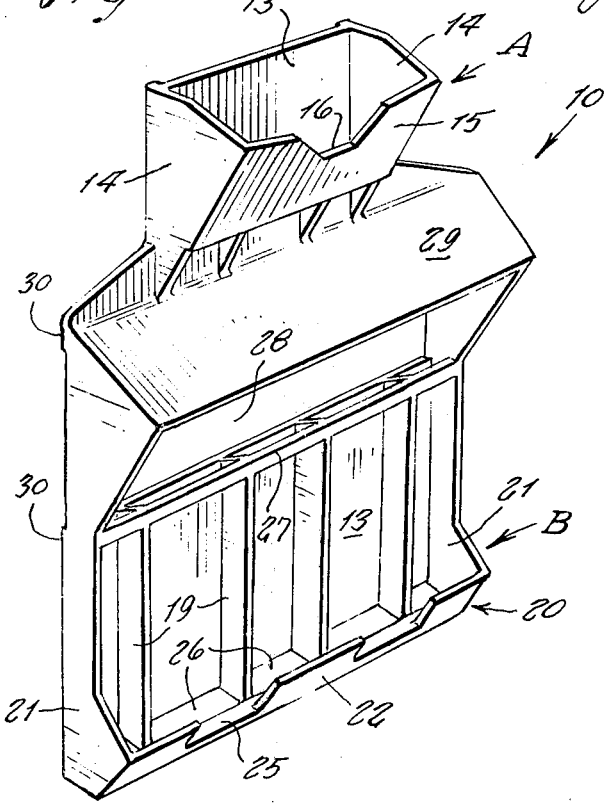
FIG. 1 is a front perspective view of the present invention.
Figure 2:
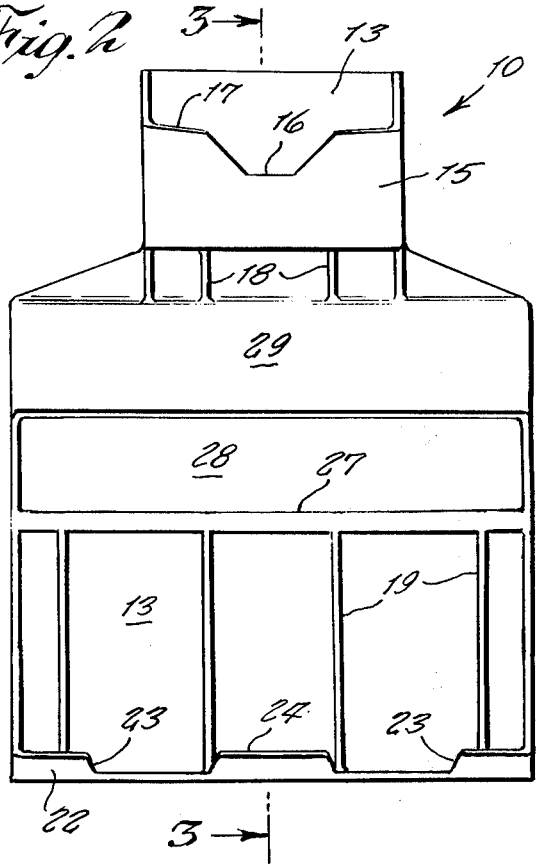
FIG. 2 is a front elevation view thereof.
Figure 5:
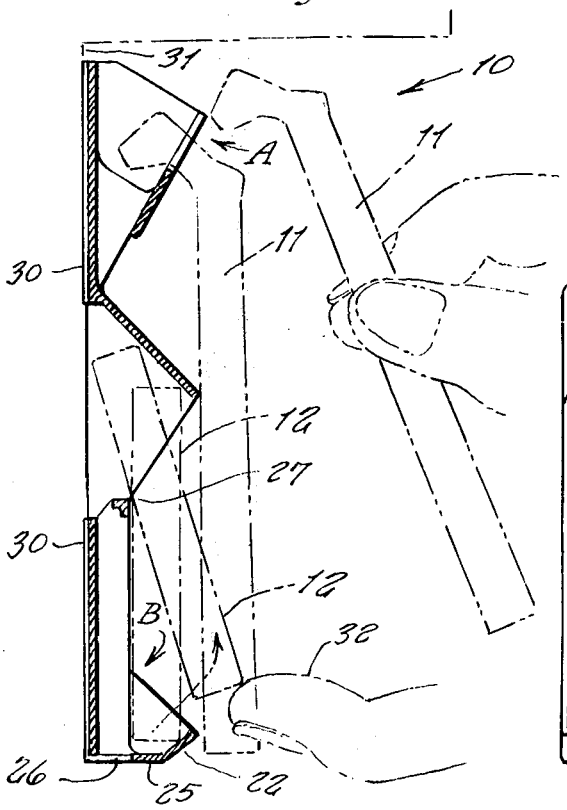

Referring now to the drawing in detail, the reference numeral 10 represents a Storage Hook according to the present invention for retaining a safety razor 11 and blade cartridge 12.

The Storage Hook 10 comprises a one piece member made preferably by being molded of rigid plastic or other moldable materials in order to be inexpensive to manufacture, and to eliminate hidden crevices that hold germs and dirt such as occurs with assembled devices.

The Storage Hook includes an upper hook A for supporting the razor, and a lower hook B for storing the blade cartridge.

The Storage Hook 10 includes a thin vertical rear wall 13, the upper portion of which is integral with parallel, spaced apart, forward extending side walls 14 and which at their front edges are integral with a downwardly rearwardly inclined front wall 15 having a notch 16 on its upper edge 17, and which serves to support the safety razor therefrom. A pair of intermediate braces 18 connect front wall 15 to the rear wall.

The lower portion of the rear wall has a plurality of vertical, spaced apart, parallel ribs 19 integral with a front side thereof. A tray 20 is formed at a bottom by means of forward extending side webs 21 which at their front edges are integral with a downwardly rearwardly inclined front wall 22 having notches 23 along its upper edge 24. The lower edge of the wall 22 is integral with a narrow bottom wall 25, and an open space 26 is formed between the rear wall 13 and the rear edge of the bottom wall so to allow air circulation therethrough and between the ribs.

A horizontal fulcrum edge 27 enjoins the upper front corners of the ribs.

An opening 28 extends completely across the middle of the rear wall 13, and a forwardly, downwardly inclined forward wall 29 is in front thereof. The opposite side edges of the wall 29 enjoin side webs 21.

The Storage Hook includes adhesive pads 30 on its rear for being supported on a vertical wall 31 of a bathroom or a cabinet. Alternately, the rear wall 13 can additionally include mounting openings for receiving mounting nails or screws, if so wished.

Figure 4:
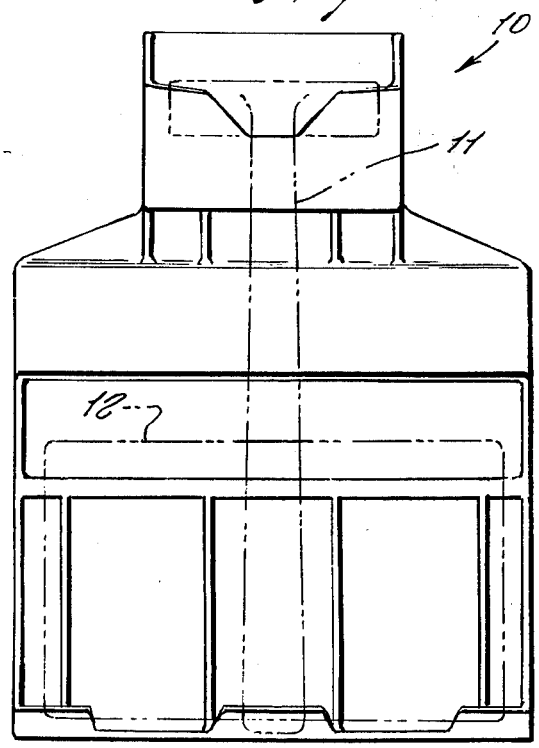
FIG. 4 is a front elevation view showing the safety razor and blade cartridge supported upon the device.

It is now evident that in operative use, as shown in FIGS. 3 and 4, the safety razor is simply placed on the upper hook A by a simple motion of dropping its head over the notch 16 and allow the razor handle to hang downward. The blade cartridge is simply dropped into the tray 20 of hook B so it rests upright against the ribs. To remove the cartridge, a finger 32 is simply placed in the notch 23, pushes up, thus causing the cartridge to pivot about the fulcrum edge 27 (as shown in FIG. 3) so its lower edge swings out forwardly and the cartridge thus easily drops into a person's hand.

It is also now evident that the bottomless cup forms a tubular throat for the circulation of air therethrough so to dry the razor head. Likewise, the cartridge resting upon the inclined wall 22 and against the ribs 19 has air circulate all around its outer surface for a same purpose.

Thus, an improved Storage Hook is provided.

I claim:

1. In a storage hook, the combination of a rear wall integral with an upper hook and a lower hook on the front side thereof, said upper hook extending outwardly and downwardly with respect to the rear wall to form a substantially triangular compartment with the apex of the triangle downward, a pair of forward extending side walls in the compartment integral at their front side edges with a front wall having a notch on the upper edge, said upper hook serving to support a safety razor with the head of the razor resting across the notch and in the triangular compartment with the razor handle hanging vertically against the front of the lower hook, said lower hook serving to support a blade cartridge, said upper and lower hooks allowing air circulation all around said razor and cartridge, said lower hook comprising a tray formed on a front side of said rear wall, said tray consisting of opposite side webs which at their forward side edges are integral with a rearwardly, downwardly inclined front wall and a plurality of ribs on a front side of said rear wall, said ribs serving to support a rear side of said cartridge when resting thereagainst, and said inclined front wall serving to support a front lower edge of said cartridge when rested at a same time thereupon.

2. The combination as set forth in claim 1, wherein an upper forward corner of said ribs is enjoined by a horizontal fulcrum member and around which said cartridge is adaptable to pivot.

3. The combination as set forth in claim 2, wherein finger notches are provided on an upper edge of said tray front wall.

* * * * *